US009407990B2

(12) United States Patent
Kim et al.

(10) Patent No.: US 9,407,990 B2
(45) Date of Patent: Aug. 2, 2016

(54) APPARATUS FOR GAIN CALIBRATION OF A MICROPHONE ARRAY AND METHOD THEREOF

(75) Inventors: Kyu-Hong Kim, Suwon-si (KR); So-Young Jeong, Seoul (KR); Kwang-Cheol Oh, Yongin-si (KR); Jae-Hoon Jeong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 243 days.

(21) Appl. No.: 12/892,078

(22) Filed: Sep. 28, 2010

(65) Prior Publication Data

US 2011/0075859 A1 Mar. 31, 2011

(30) Foreign Application Priority Data

Sep. 28, 2009 (KR) ..... 10-2009-0091824

(51) Int. Cl.
*H04R 3/00* (2006.01)
*H04R 29/00* (2006.01)

(52) U.S. Cl.
CPC ..... *H04R 3/005* (2013.01); *H04R 29/004* (2013.01); *H04R 2201/401* (2013.01)

(58) Field of Classification Search
CPC ..... H04R 1/04; H04R 1/38; H04R 1/406; H04R 3/00; H04R 3/005; H04R 3/04; H04R 25/407; H04R 29/00; H04R 29/004; H04R 29/005; H04R 2201/401; H04R 2201/403
USPC ..... 381/92, 104, 56, 91, 95, 122, 102, 107, 381/109; 375/260
See application file for complete search history.

(56) References Cited

U.S. PATENT DOCUMENTS

| | | | | |
|---|---|---|---|---|
| 6,535,610 | B1 * | 3/2003 | Stewart | 381/92 |
| 7,146,315 | B2 | 12/2006 | Balan et al. | |
| 7,203,323 | B2 | 4/2007 | Tashev | |
| 7,428,309 | B2 | 9/2008 | Malvar et al. | |
| 7,970,147 | B2 | 6/2011 | Mao | |

(Continued)

FOREIGN PATENT DOCUMENTS

| | | | |
|---|---|---|---|
| JP | 2004-289762 | A | 10/2004 |
| JP | 2007-532946 | A | 11/2007 |
| KR | 10-2008-0000478 | A | 1/2008 |

OTHER PUBLICATIONS

Ohkubo, Toshiya, et al., "Two-channel-based Noise Reduction in a Complex Spectrum Plane for Hands-free Communication System," *Journal of VLSI Signal Processing*, 2007, vol. 46, pp. 123-131.

(Continued)

*Primary Examiner* — Xu Mei
(74) *Attorney, Agent, or Firm* — NSIP Law

(57) ABSTRACT

An apparatus and method for calibrating gain difference between microphones included in a microphone array are provided. In the gain calibrating apparatus, weights for each frequency component of the acoustic signals, which have been converted into the signals in the frequency domain are calculated. The weights are used to calibrate the acoustic signals such that the plurality of acoustic signals each have the same amplitude while the acoustic signals maintain their individual phase. The amplitudes of the acoustic signals are calibrated by use of the calculated weights. The gain calibrating apparatus calibrates gain in real time while calculating weights for frequency components of the frame of acoustic signals in real time.

12 Claims, 7 Drawing Sheets

(56) References Cited

U.S. PATENT DOCUMENTS

| | | | | |
|---|---|---|---|---|
| 8,280,076 | B2 * | 10/2012 | Devantier et al. | 381/99 |
| 2003/0128848 | A1 | 7/2003 | Burnett | |
| 2003/0147538 | A1 * | 8/2003 | Elko | 381/92 |
| 2005/0063554 | A1 * | 3/2005 | Devantier et al. | 381/99 |
| 2005/0175190 | A1 * | 8/2005 | Tashev et al. | 381/92 |
| 2005/0261894 | A1 | 11/2005 | Balan et al. | |
| 2006/0140417 | A1 * | 6/2006 | Zurek | 381/92 |
| 2006/0222184 | A1 | 10/2006 | Buck et al. | |
| 2007/0047742 | A1 * | 3/2007 | Taenzer et al. | 381/92 |
| 2007/0053455 | A1 * | 3/2007 | Sugiyama | 375/260 |
| 2009/0060224 | A1 | 3/2009 | Hayakawa | |
| 2009/0234618 | A1 * | 9/2009 | Taenzer et al. | 702/189 |
| 2009/0285423 | A1 * | 11/2009 | Fischer et al. | 381/313 |
| 2010/0109951 | A1 * | 5/2010 | Taenzer | 342/442 |

OTHER PUBLICATIONS

Tashev, Ivan, "Gain Self-Calibration Procedure for Microphone Arrays," *IEEE International Conference on Multimedia and Expo*, 2004, pp. 1-4.

Korean Office Action issued on Aug. 24, 2015 in counterpart Korean Application No. 10-2009-0091824 (7 pages, with English translation).

* cited by examiner

APPARATUS FOR GAIN CALIBRATION OF A MICROPHONE ARRAY AND METHOD THEREOF

CROSS-REFERENCE TO RELATED APPLICATION(S)

This application claims the benefit under 35 U.S.C. §119 (a) of Korean Patent Application No. 10-2009-0091824, filed on Sep. 28, 2009, the disclosure of which is incorporated herein by reference in its entirety for all purposes.

BACKGROUND

1. Field

The following description relates to an apparatus for gain calibration of a microphone array and a method thereof, and more particularly, to an apparatus and method capable of adjusting the gain difference between microphones included in a microphone array.

2. Description of the Related Art

As a mobile convergence terminal including high-tech medical equipment such as high precision hearing aids, a mobile phone, UMPC, camcorders, etc. is becoming prevalent today, the demand for application products using a microphone array has been increased. A microphone array is made of multiple microphones to obtain subsidiary features of sound involving directivity, for example, the direction of sound or the location of sound sources in addition to obtaining the sound itself. The directivity is to increase the sensitivity to a sound source signal emitted from a sound source located in a predetermined direction by use of the difference in time taken until sound source signals arrive at each of the multiple microphones constituting the microphone array. If sound source signals are obtained in the above manner using a microphone array, a sound source signal input in a predetermined direction may be enhanced or suppressed.

A beamforming algorithm based noise cancellation method is applied to most algorithms using a microphone array. For example, current studies are directed toward a method of improving a voice call service and recording quality through directivity-noise cancellation, a teleconference system and intelligent conference recording system capable of automatically estimating and tracking the location of a speaker, and a robot technology for tracking a target sound.

However, if a gain mismatch between sensors occurs in most of the beam forming algorithm, the system performance of the beam forming algorithm is degraded. In particular, according to a generalized sidelobe canceller (GSC) algorithm for an adaptive beamformer, when designing a fixed beam former for enhancing a signal of a particular direction and a blocking matrix for suppressing a signal of a direction a particular direction, a gain mismatch between microphones causes signal leakage and distortion of a target sound source and fails to provide noise suppression, and this causes degradation of the performance of GSC. In addition, the gain difference between microphones distorts the shape of beam during a beamforming process, a desired beam is not formed.

Such a gain mismatch between microphones is caused due to characteristic differences between the microphones within the allowable error range set during manufacturing and also can be due to ageing of the microphones due to use. In order to reduce the characteristic differences between the microphones, the manufacturing process needs to be focused on reducing the difference in quality of the microphones, thereby reducing the possibility of a gain mismatch between microphones. However, this gain mismatch reducing method has limitations with respect to a low cost microphone array due to the high cost involved in utilizing this method.

SUMMARY

In one general aspect, there is provided an apparatus for calibrating gains of a microphone array, the apparatus including: a microphone array, including at least two microphones disposed on the same plane, a frequency conversion unit configured to convert a plurality of acoustic signals received from the microphone array into signals of a frequency domain, a weight calculation unit configured to calculate weights for each frequency component of the acoustic signals, the acoustic signals having been converted into the signals in the frequency domain, the weights being used to calibrate the acoustic signals such that the plurality of acoustic signals each includes a same amplitude while the acoustic signals maintain their individual phase, and a scaling unit configured to calibrate the amplitudes of the acoustic signals by use of the calculated weights, wherein the weight calculation unit is further configured to calculate the weights at preset time intervals or after preset number of acoustic-signal frames have elapsed.

The apparatus may further include that the weight calibration unit is further configured to calculate the weights such that the acoustic signals each include an amplitude value which is the same as a mean amplitude value of the acoustic signals.

The apparatus may further include that the weight calculation unit is further configured to calculate the weights such that each acoustic signal includes an amplitude value which is the same as that of one of the acoustic signals.

The apparatus may further include: a storage unit configured to store previously-calculated weights, wherein the weight calculation unit is further configured to update the stored weights by reflecting the calculated weights in the stored weights, and wherein the scaling unit is further configured to calibrate the amplitudes of the acoustic signals by use of the updated weights.

The apparatus may further include an application-operation unit configured to perform an action including at least one of: beamforming, noise cancellation and location tracking of acoustic signals on the acoustic signals having calibrated amplitudes.

In another general aspect, there is provided a method of calibrating gains of a microphone array, the method including: converting a plurality of acoustic signals received from a microphone array into signals of a frequency domain, the microphone array including at least two microphones disposed on the same plane, calculating weights for each frequency component of the acoustic signals, the acoustic signals having been converted into the signals in the frequency domain, the weights being used to calibrate the acoustic signals such that the plurality of acoustic signal each includes a same amplitude while the acoustic signals maintain their individual phase, and calibrating the amplitudes of the acoustic signals by use of the calculated weights, wherein the calibrating of weights is performed at a preset time interval or after a preset number of acoustic-signal frames has elapsed.

The method may further include that, in the calculating of the weights, the weights are calculated such that the acoustic signals each include an amplitude value which is the same as a mean amplitude value of the acoustic signals.

The method may further include that, in the calculating of the weights, the weights are calculated such that each acoustic signal includes an amplitude value which is the same as that of one of the acoustic signals.

The method may further include: storing the calculated weights, and updating the stored weights by reflecting newly calculated weights in the stored weight, wherein, in the calibrating of the amplitudes, the amplitudes of the acoustic signals are calibrated by use of the updated weights.

The method may further include performing an action including at least one of: beamforming, noise cancellation and location tracking of the acoustic signals on the acoustic signals having calibrated amplitudes.

Other features and aspects may be apparent from the following detailed description, the drawings, and the claims.

Figure 1:
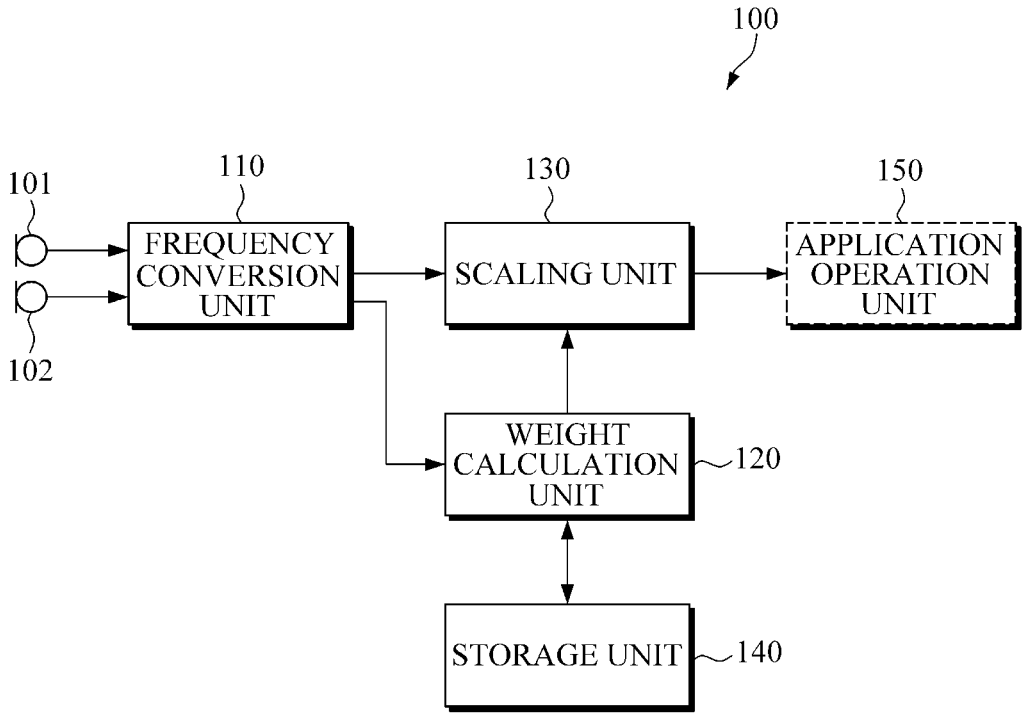
FIG. 1 is a block diagram illustrating an example of an apparatus for calibrating gains of a microphone array.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

FIG. 1 is a block diagram illustrating an example of an apparatus for calibrating gains of a microphone array.

Referring to FIG. 1, an apparatus for calibrating gains of a microphone array 100 (hereinafter "gain calibrating apparatus 100") may include a first microphone 101, a second microphone 102, a frequency conversion unit 110, a weight calculation unit 120, a scaling unit 130, a storage unit 140, and an application operation unit 150. The gain calibrating apparatus 100 may be implemented in various forms of electronic equipment such as a personal computer, a server computer, a handheld apparatus, a laptop apparatus, a multi-processor system, a microprocessor system and a set top box.

As a non-exhaustive illustration only, the gain calibrating apparatus 100 described herein may refer to mobile devices such as a cellular phone, a personal digital assistant (PDA), a digital camera, a portable game console, and an MP3 player, a portable/personal multimedia player (PMP), a handheld e-book, a portable tablet and/or laptop PC, a global positioning system (GPS) navigation, and devices such as a desktop PC, a high definition television (HDTV), an optical disc player, a setup box, and the like capable of wireless communication or network communication consistent with that disclosed herein.

The first microphone 101 and the second microphone 102 may include an amplifier and an analog/digital converter to convert input acoustic signals into electrical signals. Although two microphones 101 and 102 are provided in the gain calibrating apparatus 100 shown in FIG. 1, the configuration of microphones is not limited thereto. For example, a microphone array provided with two or more microphones in the form of a line or a circle may be used in the gain calibrating apparatus 100. Other numbers and geometries are also contemplated.

The microphones 101 and 102 may be disposed on the same plane of the gain calibrating apparatus 100 of the microphone array. For example, the microphones 101 and 102 may be arranged on the front surface or the side surface of the gain calibrating apparatus 100.

The frequency conversion unit 110 may receive acoustic signals in the time domain from each of the microphones 101 and 102 and may convert the received acoustic signals into acoustic signals in the frequency domain. For example, the frequency conversion unit 110 may convert acoustic signals in the time domain into acoustic signals in the frequency domain by use of a Discrete Fourier Transform (DFT) or a Fast Fourier Transform (FFT).

The frequency conversion unit 110 may generate a frame of each acoustic signal received from the microphones 101 and 102 and may convert the acoustic signals in a frame unit to acoustic signals in the frequency domain. The framing unit for framing acoustic signals may be determined based on the sampling frequency and the type of application.

The weight calculation unit 120 may calculate weights used to calibrate gains of a plurality of microphones 101 and 102 for acoustic signals. The weights calculation unit 120 may calculate weights which are used to calibrate a plurality of acoustic signals, which has been converted in the frequency domain, such that the acoustic signals each have the same amplitude while the acoustic signals maintain their individual phase.

The weight calculation unit 120 may calculate weights for each of frequency components included in each frame of acoustic signal in the frequency domain. Gain characteristics of the microphones 101 and 102 may differ with each other relative to each of frequency components.

The weight calculation unit 120 may receive a plurality of acoustic signals, each of which having been converted in the frequency domain, from the microphones 101 and 102. The weight calculation unit 120 may calculate the weights for a plurality of acoustic signals such that the acoustic signals each have a mean amplitude value of the acoustic signals. Alternatively, the weight calculation unit 120 may calculate the weights such that the acoustic signals each have an amplitude value of one of the acoustic signals. The weights may be applied to the acoustic signals, calibrating gains of the microphones 101 and 102.

The weight calculation unit 120 may calculate weights for frequency components of the frame of acoustic signals in real time. However, the weights may not vary rapidly with time, so the weight calculation unit 120 may not need to calculate the weights of frequency components at each frame of acoustic signals. The weight calculation unit 120 may calculate the weights at preset time intervals or after a preset number of acoustic-signal frames have elapsed. For example, the weight calculation unit 120 may calculate the weights every 100 frames. In this manner, the weight calculation unit 120 may not calculate the weight at each frame but may calculate the weight at preset time intervals or after a preset number of acoustic-signal frames have elapsed, so the power consumption important to a small sized electronic device may be reduced.

The storage unit 150 may store data and software required to drive the gain calibrating apparatus 100. The storage unit 140 may store weights, which have been previously calculated in the weight calculation unit 120.

If the weight calculation unit 120 newly calculates weights for frequency components of a frame of acoustic signals, the weight stored in the storage unit 150 may be updated by reflecting the newly calculated weights to the weights stored in the storage unit 140. When weights for each frequency component constitutes a weight set, the weight calculation unit 120 may update weights by assigning a preset portion of weights on a stored weight set and a newly calculated weight set. In one example, the weights assigned on the stored weight set and the newly calculated weights may sum to 1.

The scaling unit 130 may calibrate each amplitude of a plurality of acoustic signals using the calculated weights. The scaling unit 130 may calibrate the amplitudes of the acoustic signals by multiplying the acoustic signals in a frame unit by the calculated weights for frequency components.

The application operation unit 150 may perform various algorithms by receiving the acoustic signals having calibrated amplitudes. For example, the application operation unit 150 may perform noise cancellation, beamforming or location tracking on the acoustic signals having calibrated amplitudes. That is, the frequency conversion unit 110, the gain calibration unit 120, and the scaling unit 130 may serve as a front-end unit for various acoustic processing apparatus.

Figure 2:
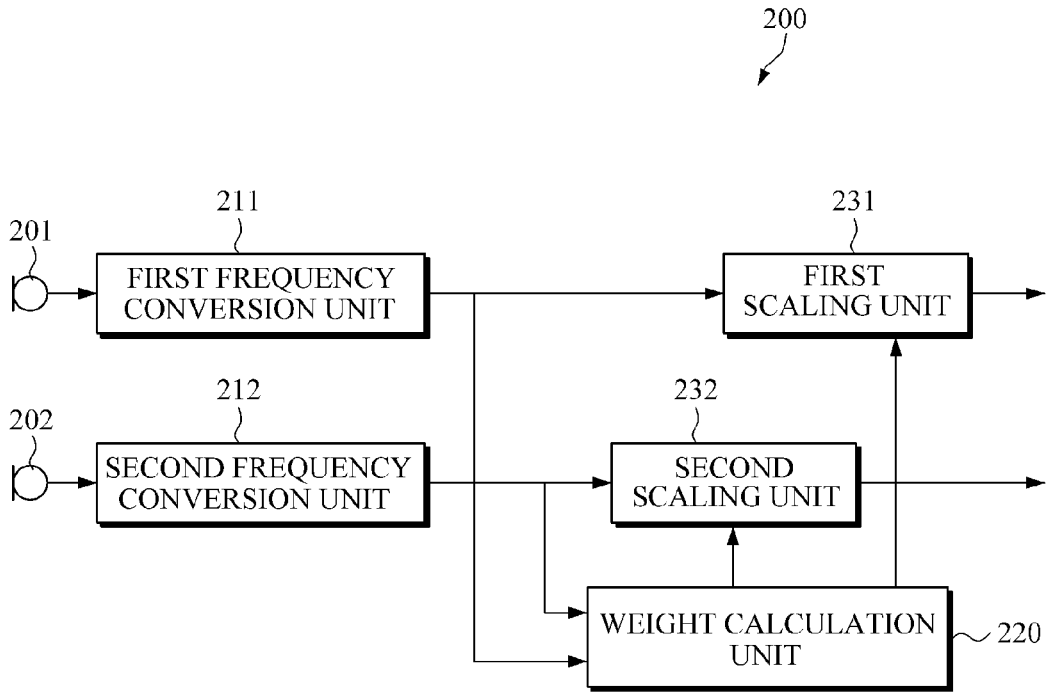
FIG. 2 is a block diagram illustrating an example of detailed configuration of the gain calibrating apparatus shown in FIG. 1.

FIG. 2 is a block diagram illustrating an example of a detailed configuration of the gain calibrating apparatus shown in FIG. 1.

A first frequency conversion unit 211 may convert a first acoustic signal received from a first microphone 201 into a signal in the frequency domain. A second frequency conversion unit 212 may convert a second acoustic signal received from a second microphone 202 into a signal in the frequency domain.

A weight calculation unit 220 may calculate weights for the first acoustic signal and weights for the second acoustic signal such that the first acoustic signal and the second acoustic signal each have an amplitude which is the same as a mean amplitude value of the first acoustic signal and the second acoustic signal.

A first scaling unit 231 may modulate an amplitude of the first acoustic signal by applying the calculated first weight to the first acoustic signal. A second scaling unit 232 may modulate an amplitude of the second acoustic signal by applying the calculated second weight to the second acoustic signal. The amplitude-modulated first acoustic signal and the amplitude-modulated second acoustic signal may be output to a processing module for beamforming and noise cancellation and the like.

Figure 3:
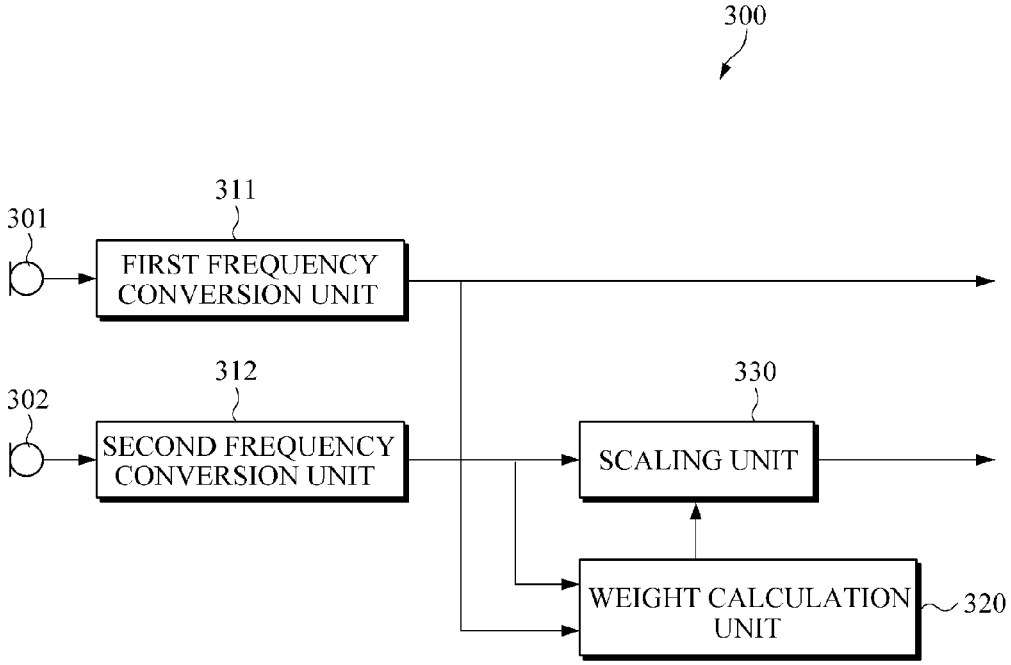
FIG. 3 is a block diagram showing another example of detailed configuration of the gain calibrating apparatus shown in FIG. 1.

FIG. 3 is a block diagram showing another example of a detailed configuration of the gain calibrating apparatus shown in FIG. 1.

A first frequency conversion unit 311 may convert a first acoustic signal received from a first microphone 301 into a signal in the frequency domain. A second frequency conversion unit 312 may convert a second acoustic signal received from a second microphone 302 into a signal in the frequency domain.

A weight calculation unit 320 may calculate weights for the first acoustic signal and the second acoustic signal such that the first acoustic signal and the second acoustic signal each has the same amplitude value as that of one of the first acoustic signal and the second acoustic signal.

In FIG. 3, the weight calculation unit 320 may calculate weights of the second acoustic signal such that the second acoustic signal has the same amplitude value as that of the first acoustic signal.

A scaling unit 330 may modulate an amplitude of the second acoustic signal by applying the calculated weight to the second acoustic signal. The amplitude-modulated second acoustic signal may be output to a processing module for beamforming and noise cancellation.

In FIGS. 2 and 3, the example gain calibration is performed on two acoustic signals but the number of acoustic signals input to the processing module is not so limited.

Figure 4A:
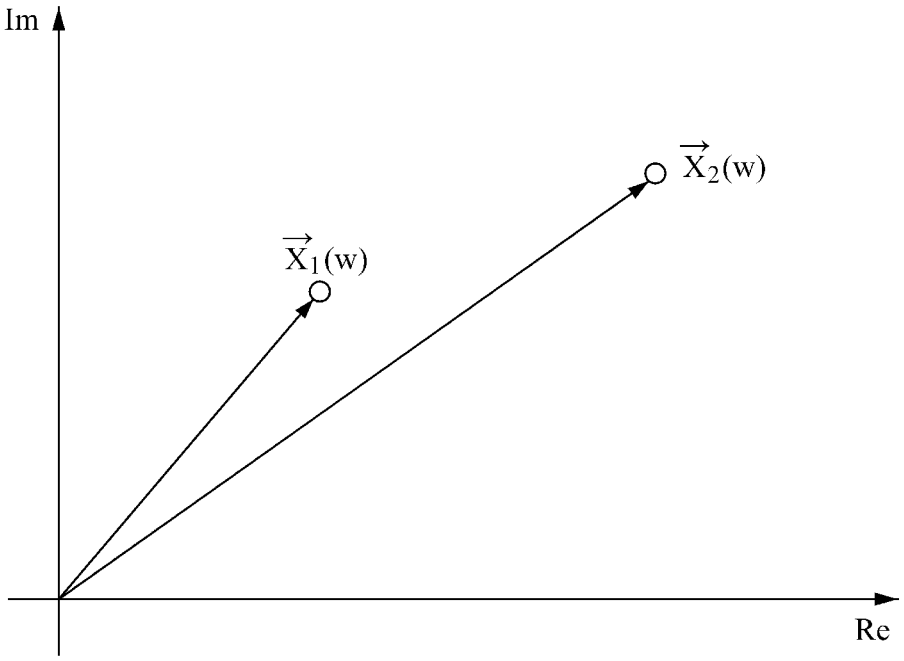
FIG. 4A is a graph illustrating signals input into two microphones that are represented in the complex domain.
Figure 4B:
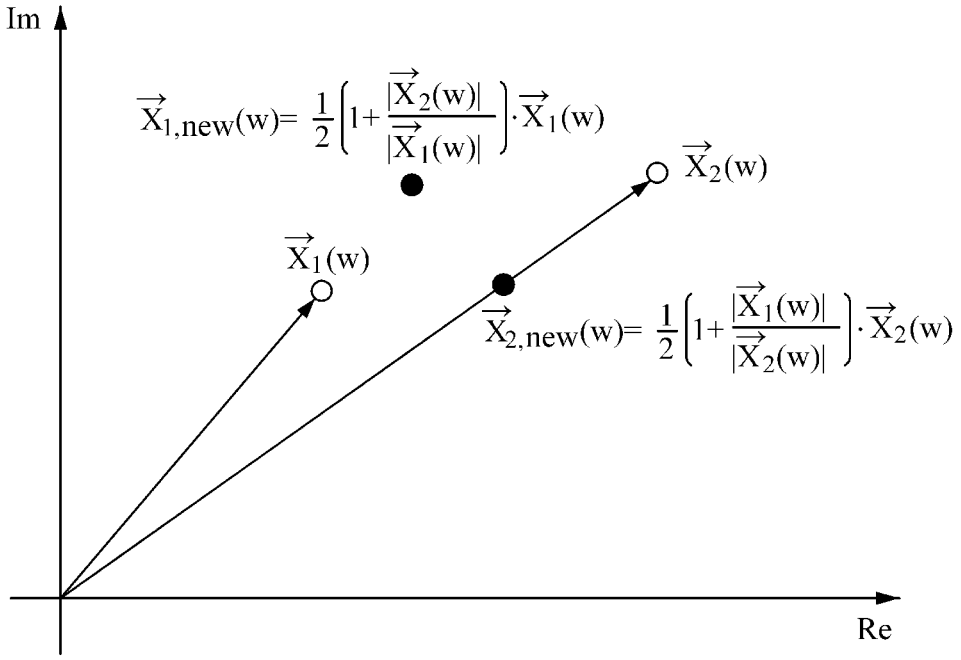
FIG. 4B is a graph illustrating an example of gain calibration with respect to the signals shown in FIG. 4A.
Figure 4C:
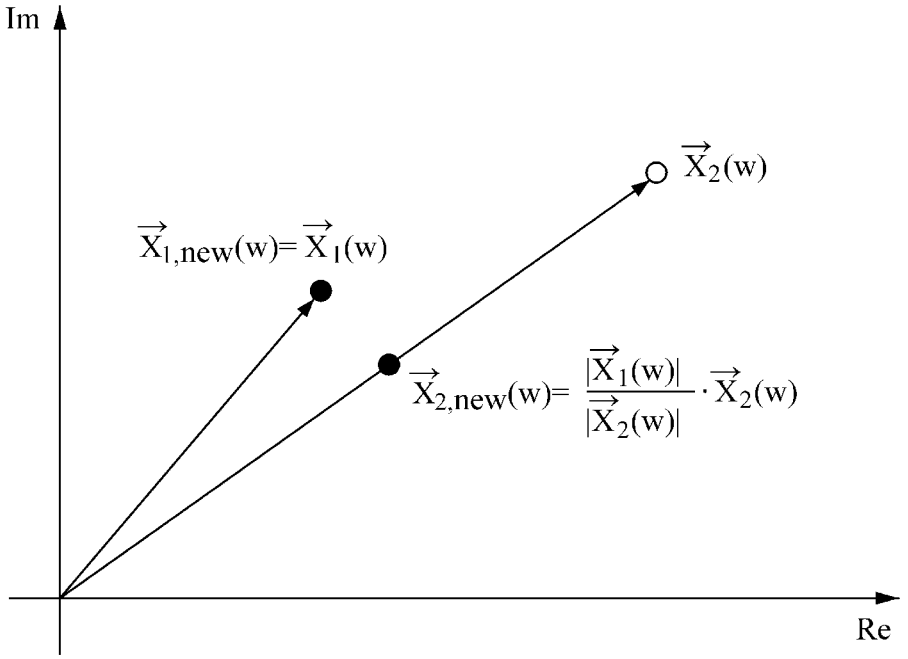
FIG. 4C is a graph illustrating another example of gain calibration with respect to the signals of FIG. 4A.

FIG. 4A is a graph illustrating signals input into two microphones that represented in the complex domain, FIG. 4B is a graph illustrating an example of gain calibration with respect to the signals shown in FIG. 4A, and FIG. 4C is a graph illustrating another example of gain calibration with respect to the signals of FIG. 4A.

As shown in FIG. 4A, a first acoustic signal x1($t$) and a second acoustic signal x2($t$) with respect to one frequency are expressed in the complex domain as $\vec{X}_1(\omega)$ and $\vec{X}_2(\omega)$, respectively. In addition, if the first and second acoustic signals $\vec{X}_1(\omega)$ and $\vec{X}_2(\omega)$ are amplitude-modulated while maintaining their individual phase component, the first acoustic signal and second acoustic signal are expressed as $\vec{X}_{1,new}(\omega)$ and $\vec{X}_{2,new}(\omega)$, respectively. The relationship between the first acoustic signal $\vec{X}_1(\omega)$ and the amplitude-modulated first acoustic signal $\vec{X}_{1,new}(\omega)$ is expressed in Equation 1 below.

$$\vec{X}_{1,new}(\omega)=G_1(\omega)\cdot\vec{X}_1(\omega) \quad \text{[Equation 1]}$$

Herein, $G_1(\omega)$ represents a weight with respect to one frequency component of the first acoustic signal that is calculated in the weight calculation unit 120.

The relationship between the second acoustic signal $\vec{X}_2(\omega)$ and the amplitude-modulated second acoustic signal $\vec{X}_{2,new}(\omega)$ is expressed in Equation 2 below.

$$\vec{X}_{2,new}(\omega)=G_2(\omega)\cdot\vec{X}_2(\omega) \quad \text{[Equation 2]}$$

Herein, $G_2(\omega)$ represents a weight with respect to one frequency component of the second acoustic signal that is calculated in the weight calculation unit 120. The weight calculation unit 120 may calculate the weights $G_1(\omega)$ and $G_2(\omega)$ that are used to match the amplitude $|\vec{X}_{1,new}(\omega)|$ of the amplitude-modulated first acoustic signal and the amplitude $|\vec{X}_{2,new}(\omega)|$ of the amplitude-modulated second acoustic signal to each other. The weight calculation unit 120 may calculate weights with respect to all frequency components contained in the acoustic signal of a frame unit. If the acoustic signal in a frame unit includes 256 frequency components, the weight calculation unit 120 may calculate 256 weights $G_1(\omega)$ and 256 weights $G_2(\omega)$.

FIG. 4B is a graph illustrating an example of gain calibration performed with respect to the signals shown in FIG. 4A that has been described with reference to FIG. 3.

Referring again to FIG. 2, the first weight calculation unit 222 may calculate the weights as expressed by Equation 3, and the second weight calculation unit 224 may calculate the weights as expressed by Equation 4.

$$G_1(\omega) = \frac{1}{2}\left(1 + \frac{|\vec{X}_2(\omega)|}{|\vec{X}_1(\omega)|}\right) \quad \text{[Equation 3]}$$

$$G_2(\omega) = \frac{1}{2}\left(1 + \frac{|\vec{X}_1(\omega)|}{|\vec{X}_2(\omega)|}\right) \quad \text{[Equation 4]}$$

FIG. 4C is a graph illustrating an example of gain calibration described with reference to FIG. 3 in which the gain calibration is performed with respect to one of input signals.

Referring again to FIG. 3, $G_1(\omega)=1$, and the weight calculation unit 320 may calculate the weight $G_2(\omega)$ as expressed by equation 5.

$$G_2(\omega) = \frac{|\vec{X}_1(\omega)|}{|\vec{X}_2(\omega)|} \quad \text{[Equation 5]}$$

Figure 5:
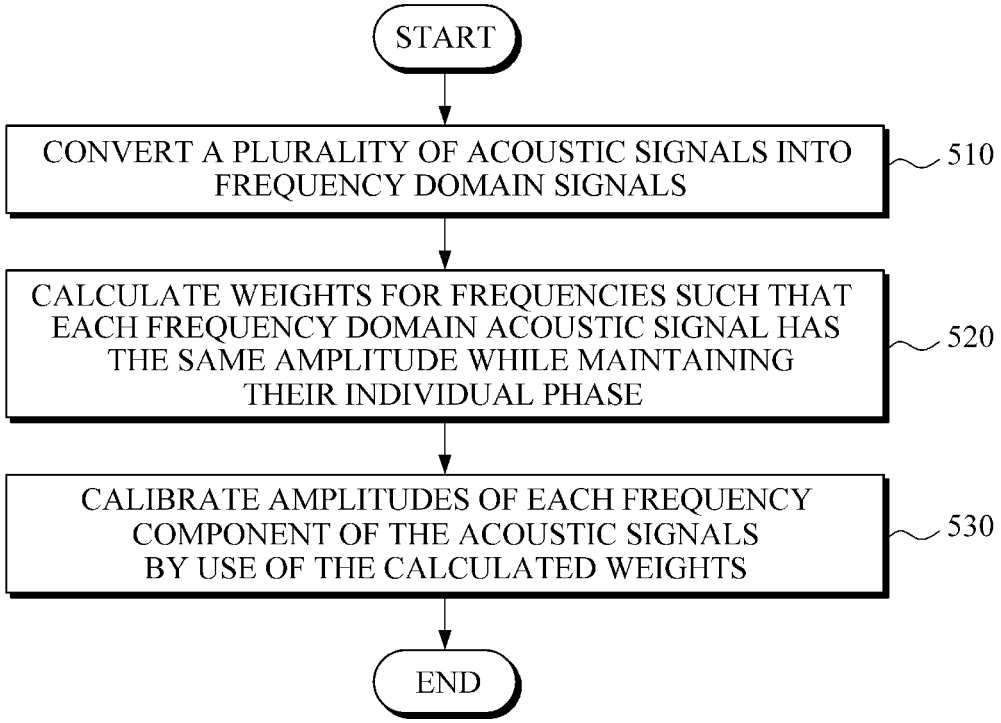
FIG. 5 is a flowchart showing an example of a method of calibrating gains of a microphone array.

FIG. 5 is a flowchart showing an example of a method of calibrating gains of a microphone array.

As shown in FIGS. 1 and 5, in operation 510, the frequency conversion unit 110 may convert a plurality of acoustic signals into signals in the frequency domain.

The weight calculation unit 120 may calculate weights for each frequency component of the acoustic signals, which have been converted into the signals in the frequency domain. In operation 520, the weights may be used to calibrate the acoustic signals such that the acoustic signals have the same amplitude while the acoustic signals maintain their individual phases. To this end, the weight calculation unit 120 may calculate the weights such that the acoustic signals each have an amplitude value of one of the acoustic signals. Alternatively, the weight calculation unit 120 may calculate the weights such that the acoustic signals each have a mean amplitude value of the acoustic signals. The calculating of weights may be performed at a preset time interval or after a preset number of acoustic-signal frames have elapsed.

After previously calculated weights are stored, the weight calculation unit 120 may newly calculate weights and then may update the stored weights by reflecting the newly calculated weights to the stored weights.

In operation 530, the scaling unit 130 may calibrate the amplitudes of the acoustic signals by use of the calculated weights. After the weights have been updated, the scaling unit 130 may calibrate the amplitudes of the acoustic signals using the updated weights.

According to the examples of gain calibration apparatus and method, the difference in gain of inputs to each microphone can be calibrated at the frequency domain using less calculation regardless of the direction or number of ambient sound sources or the presence of noise. In calibrating a fixed gain control and performing a back end processing such as noise reducing using the calibrated gain control, the input of a user is not necessary and the degradation of back-end processing efficiency due to accumulated initial error is prevented. In addition, examples of gain calibration apparatus and method calibrates the difference in gain of inputs of microphones in real time regardless of touch, button click and vibration, so that the examples of gain calibration apparatus and method can be effectively applied to a microphone array of a mobile apparatus.

The processes, functions, methods and/or software described above may be recorded, stored, or fixed in one or more computer-readable storage media that includes program instructions to be implemented by a computer to cause a processor to execute or perform the program instructions. The media may also include, alone or in combination with the program instructions, data files, data structures, and the like. The media and program instructions may be those specially designed and constructed, or they may be of the kind well-known and available to those having skill in the computer software arts. Examples of computer-readable media include magnetic media, such as hard disks, floppy disks, and magnetic tape; optical media such as CD-ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa. In addition, a computer-readable storage medium may be distributed among computer systems connected through a network and computer-readable codes or program instructions may be stored and executed in a decentralized manner.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A method of calibrating gains of a microphone array receiving a plurality of acoustic signals, the method comprising:

calculating a weight for each frequency component of each of the acoustic signals received from the microphone array; and calibrating amplitudes of the acoustic signals using the calculated weights such that each of the calibrated acoustic signals comprises the same amplitude, but maintains an individual phase, for each frequency component, wherein the acoustic signals comprise a first acoustic signal and a second acoustic signal, and the calculated weight of the first acoustic signal, at each frequency component, is obtained by summing the amplitudes of the first and second acoustic signals, at the frequency component, and dividing the sum by twice the amplitude of the first acoustic signal, at the frequency component.

2. The method of claim 1, further comprising:

storing the calculated weights; and updating the stored weights by reflecting newly calculated weights in the stored weights, wherein in the calibrating of the amplitudes, the amplitudes of the acoustic signals are calibrated by use of the updated weights.

3. The method of claim 1, further comprising performing an action comprising at least one of: beamforming, noise cancellation and location tracking of the acoustic signals on the acoustic signals having calibrated amplitudes.

4. An apparatus for calibrating gains of a microphone array receiving a plurality of acoustic signals, the apparatus comprising:

the microphone array comprising two microphones disposed on the same plane;

a weight calculation unit configured to calculate a weight for each frequency component of each acoustic signal received from the microphone array; and a scaling unit configured to calibrate amplitudes of the acoustic signals using the calculated weights such that each of the calibrated acoustic signals has the same amplitude, but maintains an individual phase, for each frequency component, wherein the acoustic signals comprise a first acoustic signal and a second acoustic signal, and the calculated weight of the first acoustic signal, at each frequency component, is obtained by summing the amplitudes of the first and second acoustic signals, at the frequency component, and dividing the sum by twice the amplitude of the first acoustic signal, at the frequency component.

5. The apparatus of claim 4, further comprising:

a storage unit configured to store previously-calculated weights, wherein the weight calculation unit is further configured to update the stored weights by reflecting the calculated weights in the stored weights, and wherein the scaling unit is further configured to calibrate the amplitudes of the acoustic signals by use of the updated weights.

6. The apparatus of claim 4, further comprising an application-operation unit configured to perform an action comprising at least one of: beamforming, noise cancellation and location tracking of acoustic signals on the acoustic signals having calibrated amplitudes.

7. An apparatus for calibrating gains of a microphone array receiving a plurality of acoustic signals, the apparatus comprising:

the microphone array comprising two microphones disposed on the same plane;

a weight calculation unit configured to calculate a weight for each frequency component of each acoustic signal received from the microphone array; and a scaling unit configured to calibrate amplitudes of the acoustic signals using the calculated weights such that each of the calibrated acoustic signals has the same amplitude, but maintains an individual phase, for each frequency component, wherein the acoustic signals comprise a first acoustic signal and a second acoustic signal, and the calculated weight of the first acoustic signal, at each frequency component, is obtained by dividing the amplitude of the second acoustic signal, at the frequency component, by the amplitude of the first acoustic signal, at the frequency component.

8. The apparatus of claim 7, further comprising:

a storage unit configured to store previously-calculated weights, wherein the weight calculation unit is further configured to update the stored weights by reflecting the calculated weights in the stored weights, and wherein the scaling unit is further configured to calibrate the amplitudes of the acoustic signals by use of the updated weights.

9. The apparatus of claim 7, further comprising an application-operation unit configured to perform an action comprising at least one of: beamforming, noise cancellation and location tracking of acoustic signals on the acoustic signals having calibrated amplitudes.

10. A method of calibrating gains of a microphone array receiving a plurality of acoustic signals, the method comprising:

calculating a weight for each frequency component of each of the acoustic signals received from the microphone array; and calibrating amplitudes of the acoustic signals using the calculated weights such that each of the calibrated acoustic signals comprises the same amplitude, but maintains an individual phase, for each frequency component, wherein the acoustic signals comprise a first acoustic signal and a second acoustic signal, and the calculated weight of the first acoustic signal, at each frequency component, is obtained by dividing the amplitude of the second acoustic signal, at the frequency component, by the amplitude of the first acoustic signal, at the frequency component.

11. The method of claim 10, further comprising:

storing the calculated weights; and updating the stored weights by reflecting newly calculated weights in the stored weights, wherein in the calibrating of the amplitudes, the amplitudes of the acoustic signals are calibrated by use of the updated weights.

12. The method of claim 10, further comprising performing an action comprising at least one of: beamforming, noise cancellation and location tracking of the acoustic signals on the acoustic signals having calibrated amplitudes.

* * * * *